US007068162B2

(12) United States Patent
Maple et al.

(10) Patent No.: US 7,068,162 B2
(45) Date of Patent: Jun. 27, 2006

(54) COMPARTMENT SECURITY SYSTEM

(76) Inventors: Alan James Maple, 7 Linley Road., Cheadle Hulme, Cheadle, Cheshire (GB) SK8 7HP; Ian Martin Lennard, 9 Upton Avenue, Cheadle Hulme, Cheadle, Cheshire (GB) SK8 7HX ( * ) Notice: Subject to any disclaimer, the term of this patent is extended or adjusted under 35 U.S.C. 154(b) by 201 days.

(21) Appl. No.: 10/604,049

(22) Filed: Jun. 24, 2003

(65) Prior Publication Data

US 2004/0263332 A1 Dec. 30, 2004

(51) Int. Cl.
*G08B 1/08* (2006.01)

(52) U.S. Cl. ..... 340/539.11; 340/539.13; 340/568.1; 340/568.2; 340/571; 340/542; 340/426.28

(58) Field of Classification Search ..... 340/568.2, 340/571, 542, 426.28, 505, 426.23, 568.4, 340/691.4, 825.36, 539.13, 539.11, 568.1; 70/212, 237, 258, 164, 14, 211, 34
See application file for complete search history.

(56) References Cited

U.S. PATENT DOCUMENTS

| | | | | |
|---|---|---|---|---|
| 4,750,197 | A * | 6/1988 | Denekamp et al. | 455/404.2 |
| 4,766,419 | A | 8/1988 | Hayward | |
| 5,615,247 | A * | 3/1997 | Mills | 455/411 |
| 5,656,996 | A * | 8/1997 | Houser | 340/541 |
| 5,826,195 | A | 10/1998 | Westerlage et al. | |
| 5,907,286 | A * | 5/1999 | Kuma | 340/5.5 |
| 6,069,563 | A * | 5/2000 | Kadner et al. | 340/571 |
| 6,420,971 | B1 * | 7/2002 | Leck et al. | 340/542 |
| 6,753,775 | B1 * | 6/2004 | Auerbach et al. | 340/539.22 |
| 2001/0015691 | A1 * | 8/2001 | Mellen et al. | 340/5.2 |
| 2003/0102957 | A1 * | 6/2003 | Crisp | 340/5.2 |
| 2003/0160695 | A1 * | 8/2003 | Hisano | 340/539.13 |
| 2004/0108938 | A1 * | 6/2004 | Entrekin | 340/5.73 |
| 2004/0113783 | A1 * | 6/2004 | Yagesh | 340/568.1 |

FOREIGN PATENT DOCUMENTS

| | | |
|---|---|---|
| EP | 0332434 A2 | 9/1989 |
| GB | 2353425 A | 2/2001 |
| GB | 2368174 A | 4/2002 |

* cited by examiner

*Primary Examiner*—Toan N. Pham
(74) *Attorney, Agent, or Firm*—McGarry Bair PC

(57) ABSTRACT

A security system for a goods-carrying compartment such as of a vehicle is arranged to indicate the sealed status of an access door 40 to the compartment. Following loading of the compartment, the system is used to seal the door closed by passing a security cable 34 through components 46, 50 of a lock mechanism associated with that door. The cable 34 is re-entered into the system housing 30 and then, using a key inserted into a security switch 14, the system is activated to show proper sealing. An interrogation switch 12 may be pressed to illuminate LED 22 if the door 40 has not been opened following sealing or LED 24 if the door has been opened and not properly re-sealed with a key. Two different keys may be provided, one for use with the initial sealing of the compartment and the other for re-sealing by an authorized person such as a driver, so long as the compartment was opened for a legitimate purpose on route between dispatch and the ultimate destination.

20 Claims, 2 Drawing Sheets

42
40
46
44
30
48
50
34
38
36
22
32
24
12
14

COMPARTMENT SECURITY SYSTEM

BACKGROUND OF INVENTION

1. Field of the Invention

This invention relates to a security system for a compartment having a closure member. In particular, but not exclusively, the invention relates to a security system for the goods-carrying compartment of a commercial vehicle or truck provided with a closable access door, in order to permit monitoring of opening and closing of the access door.

In this specification, references to the sealing of a compartment are intended to mean that access to the compartment is restricted in a secure, verifiable and tamper-proof manner, rather than meaning the compartment is physically closed in such a way as to be airtight or watertight. In a case where the compartment has an access door, the sealing of that door may involve physically locking the door in a closed position, so long as when so closed, the maintenance of that state may be monitored by the security system.

2. Description of the Related Art

There are increasing concerns about ensuring the integrity of goods carried by commercial vehicles and trucks, in cargo containers as used on ships and on aircraft, and in other circumstances where the recipient of those goods wishes to be assured that they have not been tampered with, contaminated or otherwise spoiled following packing and dispatch from a warehouse, depot or manufacturing plant. Various systems have been developed in order to permit the sealing of a goods compartment whereby the integrity of that seal may be checked at the intended destination for the goods, to see whether access has been gained to the interior of the compartment.

In U.S. Pat. No. 4,766,419 (Hayward), there is disclosed a security device for use with the door of a cargo container or goods compartment. The device is activated by closing and sealing the door the container or compartment, and generates a random or pseudo-random number or code which is recorded both at the dispatch site and also on a sheet of paper which travels with the goods or otherwise is transferred to the destination. When the container arrives at the destination, the number displayed by the system may be compared that recorded at the dispatch site. Security may be enhanced by checking that number back to the dispatch site by a telecommunications link, and if the numbers all match, then the goods may be accepted. If the numbers do not match, then the compartment will have been opened on route between the dispatch site and the destination and the appropriate action taken, such as refusing delivery of the goods.

The above system suffers from the disadvantage of having to record the generated number or code, and then to ensure that the code is stored both at the dispatch site and is transferred to the destination. This leads to operator inconvenience, for all the personnel involved. An improvement of this security system is described in UK Patent Publication No. 2,368,174-A (Encrypta), but this is primarily concerned with effecting the seal, rather than determining the integrity of that seal whilst the compartment is in transit.

In UK Patent Publication No. 2,353,425-A (Maple et al), there is disclosed a security system for use with a GPS system, whereby the system allows opening of a goods compartment only when the GPS detects the compartment is located at a pre-programmed destination. If the compartment is opened elsewhere, the system records this and informs the recipient at the destination, who again may take the appropriate action. This system has the disadvantage that it requires programming with the co-ordinates of the or each destination at which goods are to be delivered, and also there may be a malfunction if such a destination has only a weak or no GPS signal.

Other security systems are to be found in U.S. Pat. No. 5,826,195 (Westerlage et al), which uses a cellular telephone network, and European Patent Publication No. 0,332,434-A (Security Services), which uses a wireless navigation system similar to GPS.

SUMMARY OF INVENTION

This invention aims at improving and simplifying the above-described security systems, so as to facilitate the sealing of a goods compartment (in the security sense) and to facilitate the verification of the integrity of goods carried within that compartment, on reaching the intended destination.

According to one aspect of this invention, there is provided a security system for a compartment having a closure member, which security system is arranged to permit sealing of the closure member and to monitor a sealed status thereof, the security system. The system comprises:

a detector for sensing opening and closing movement of the closure member and providing a detector output;

a first input device providing an electrical first device output, the first input device being operable solely by means of an authorized user and having a first function for signifying sealing of the compartment;

a second input device providing an electrical second device output, the second input device being operable by any person and having a second function for checking the sealed status of the compartment;

an indicator having at least first and second states indicative of whether or not unauthorized access has been made to the compartment once sealed; and an access verification controller arranged to control the indicator depending upon said outputs received from the detector and the input devices.

According to another aspect of this invention, there is provided a security system for a compartment having a closure member, which security system is arranged to permit sealing of the closure member and to monitor a sealed status thereof, the security system. This second aspect of the invention comprises:

a detector for sensing opening and closing movement of the closure member and providing a detector output;

a first input device providing an electrical first device output, the first input device being operable solely by means of an authorized user and having a first function for signifying sealing of the compartment;

a second input device providing an electrical second device output, the second input device being operable any user and having a second function for checking the sealed status of the compartment;

an indicator having first, second and third states indicative of whether unauthorized or authorized access has been made to the compartment once sealed; and an access verification controller arranged to control the indicator depending upon said outputs received from the detector and the input devices, whereby the first state of the indicator corresponds to the closure member having been sealed closed by an authorized person and the compartment has not been opened thereafter, the second state of the indicator corresponds to the closure member having been opened at least once following sealing by an authorized user and then resealed by an authorized user, and the third state of the indicator corresponds to the closure member having been opened following sealing by an authorized user and then sealed again other than by an authorized user.

It will be appreciated that the security system of this invention does not rely upon GPS in order to ensure the integrity of goods when in transit. Further, there is no need to record random or pseudo-random numbers or other codes which are generated each time the compartment is closed, and to track the continuity of those numbers before an assurance can be given as to the integrity of the goods. The system of this invention is thus easier to use and implement than the described known systems.

BRIEF DESCRIPTION OF DRAWINGS

Two specific embodiments of security system of this invention will be described hereinafter and are illustrated in the accompanying drawings.

In the drawings:

FIG. 2 illustrates a seal arrangement for use with a goods compartment of a truck, a cargo container or the like.

DETAILED DESCRIPTION

Figure 2:
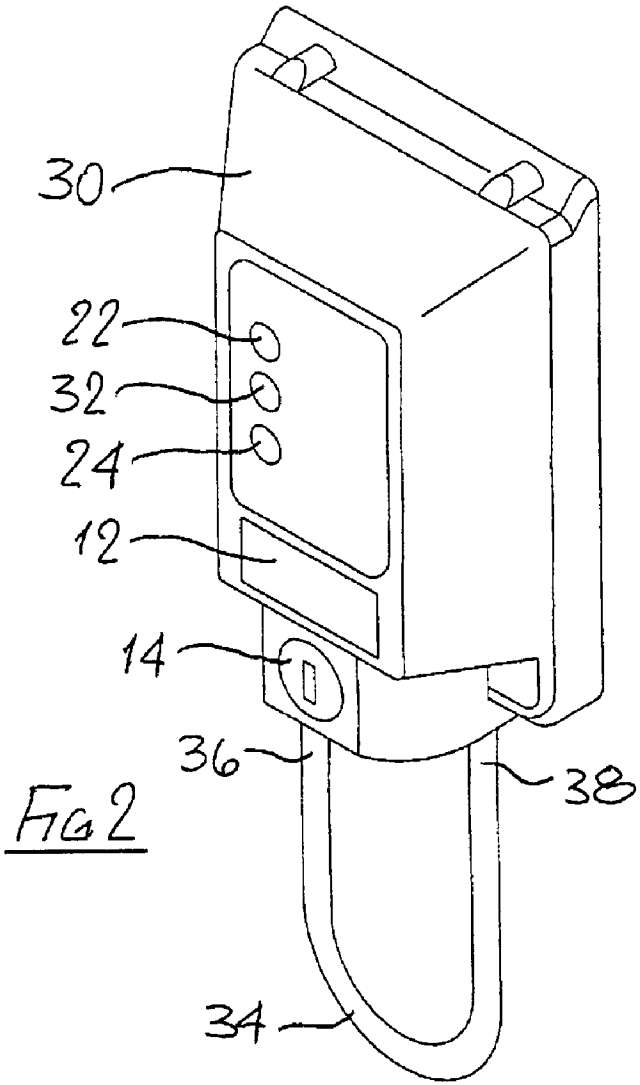

In a preferred embodiment of security system of this invention the first input device is key-operated such that it may be operated only by a user having the appropriate key. Such a user may be a warehouse manager, a team leader or a similar person who has been provided with the key and who has sufficient authority in order to ensure the loading of the compartment with goods has properly been completed. Once the compartment has been loaded and closed, the key is used to signify the sealing of the compartment, to the access verification controller of the system.

In one embodiment, the indicator utilizes first and second indicator lights so as to indicate to personnel the sealed status of the compartment. The first light may be associated with a first state and indicates that the closure member has been sealed closed by the authorized user and the compartment has not been opened thereafter. The second light may be associated with a second state and indicates that the compartment has been opened following sealing by an authorized user. Even if the compartment is closed and sealed again, said other such light will still indicate the compartment has been opened, unless the second sealing is also performed by an authorized user having an appropriate key.

The recipient of goods within the compartment may operate the second input device so as to activate the indicator. If the indicator shows the compartment has been sealed closed and not reopened, then the integrity of the goods is assured. Conversely, if the second light is illuminated, then the recipient is made aware that the compartment has been opened following initial sealing and so may take appropriate action, such as refusing delivery of the goods.

In a highly preferred embodiment, there is a third indicated state. This may be indicated by a third light and is to show that the compartment has been opened at least once following the initial sealing by an authorized user, but then has been closed and re-sealed again by an authorized user. If, on arrival at the destination, the compartment is showing this third state, the recipient may effect enquiries to determine why the compartment was opened and resealed and then decide whether or not to refuse delivery.

This highly preferred embodiment is applicable where for example a container crosses country boundaries and the driver (or some other escort) is required to show the contents of the container to persons in authority, such as Customs officials. So long as the driver is provided with a suitable key, the driver may open the compartment for inspection and then close it and re-seal it in an authorized manner.

The access verification controller may comprise a microprocessor running an appropriate control program. That program may store all relevant data relating to openings, closings and authorized sealings of the closure member. The control program may associate with that data time and date information concerning each stored event. The control program may be interrogated to permit the download of the data as and when required. This may be achieved either by a plug-in hard-wired link or by a wireless link.

Figure 1:
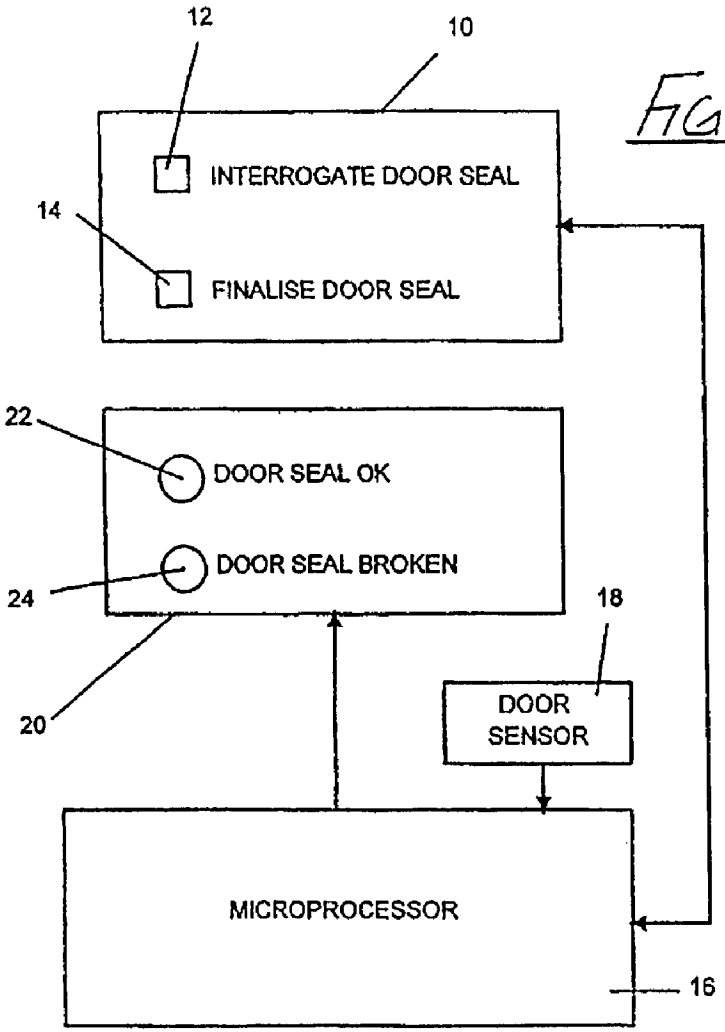
FIG. 1 is a block diagram showing a system having two indicating states and suitable for use with a goods compartment of a truck.

A first preferred embodiment of this invention will now be described with reference to FIG. 1. This embodiment serves to give assurance to a recipient of goods within a compartment that the compartment has not been opened after it has been sealed closed by an authorized person using a key, without the need to track a written number or employ a GPS system. The embodiment is primarily intended to use with a goods vehicle though could be used with other cargo containers or compartments.

The system includes an input unit 10 having a push-button interrogation switch 12 and a security switch 14. Switch 12 is labeled INTERROGATE DOOR SEAL and switch 14 is labeled FINALIZE DOOR SEAL. The input unit conveniently may be located at or adjacent the rear of a vehicle, usually on the exterior thereof. For example, the unit 10 may be located externally on one of the doors of the compartment, immediately adjacent a door handle thereof. Preferably, the unit includes a weatherproof housing for securing to the door of the compartment, or some other part of the goods compartment.

Operation of the input unit 10 is monitored by a microprocessor 16 which may be installed at any suitable location, such as within the compartment of the vehicle to prevent unauthorized access thereto. Alternatively, the micro-processor could be disposed within the housing for the input unit 10. The microprocessor 16 runs a control program which monitors the operation of the switches of the input unit as well as a sensing unit 18, arranged to detect opening and closing of a door of the goods receiving compartment.

An indicator unit 20 may also be disposed in the housing for the input unit and is controlled by the microprocessor 16. The indicator unit has two signaling devices, 22, 24 for indicating the sealed status of the vehicle compartment, in terms of whether or not any unauthorized access has been made to the compartment since it was last closed and sealed by an authorized user signaling device 22 is labeled DOOR SEAL OK and signifies, when activated, that no access has been gained to the compartment following the sealing thereof by an authorized user signaling device 24 is labeled DOOR SEAL BROKEN in order to alert a user to the fact that unauthorized access to the vehicle compartment has occurred since it was last sealed by an authorized user.

The signaling devices 22, 24 may take any appropriate form which will enable a user to differentiate between the two conditions that their operation signifies. For instance, both devices may comprise lamps such as LEDs and which have different colors e.g. green for device 22 and red for device 24. Alternatively, or in addition, the signaling devices may produce audible outputs or may be in the form of a digital read-out. In the latter case, there need be only one digital display panel which could show, in the simplest case, a 0 or a 1, or with a more complex display DOOR SEAL OK or DOOR SEAL BROKEN. Other signaling devices may be used so long as a user may differentiate between the outputs. For example, one output state could be a continuous illumination of a lamp and the other output state could be a pulsed output.

Once the vehicle compartment has been loaded with goods to be delivered, the access door to the compartment is closed and fastened or otherwise locked closed. The person responsible for closing the door may then confirm this by operating the interrogation switch 12, which operation is detected by the microprocessor 16. The control program checks the door has been closed as determined by the sensing unit 18 and causes the signaling device 24 to operate, thereby indicating that the compartment has been accessed and closed and that authorized sealing is awaited.

The microprocessor 16 may be arranged so that the security switch is only effective to change the status from DOOR SEAL BROKEN to DOOR SEAL OK if the door has been sensed closed for at least a minimum preset time interval of typically several seconds. If the security switch is operated while the sensing unit 18 registers a door open condition or before the preset time interval expires, then the microprocessor will not reset the status to DOOR SEAL OK with the consequence that the DOOR SEAL BROKEN status will show when the interrogation switch is next operated.

The responsible person for the sealing of the door is in this way alerted to the fact that further action is needed before security requirements are met. This further action involves the operation of the security switch 14 which is arranged so that only authorized personnel may carry out this operation. Thus, for example, the security switch 14 may require the insertion of a mechanical key into a key lock, or the insertion of a personal electronic key-card into a key reader. Correct operation of the security switch 14 is checked by the microprocessor which then operates signaling device 22 to indicate that the compartment has been properly sealed. Where the signaling device 22 is in the form of a lamp, the microprocessor may cause it to be illuminated for a predetermined time interval of several seconds, sufficient to allow the responsible person to verify that the proper sealing of the compartment has been finalized and the vehicle is ready to depart the loading depot, ready to effect a delivery.

When the vehicle arrives at the intended destination with a properly sealed compartment, the person responsible for unloading may ensure no tampering or contamination of the contents has occurred since the compartment was last sealed by an authorized person. This check is initiated by operating the interrogation switch 12 and observing which of the two signaling devices 22,24 is activated. If the integrity of the compartment had been breached, this would have been detected by the microprocessor 16 through the sensing unit 18. In this event, device 24 will be activated in response to the next operation of the interrogation switch 12. In the absence of any unauthorized door opening or closing activity since sealing of the compartment, signaling device 22 will be activated.

Activation of device 22 will indicate to the recipient of the goods that those goods may be accepted. On opening the door, the microprocessor 16 will automatically reset the status as DOOR SEAL BROKEN. Conversely, activation of device 24 indicates an unauthorized breach of compartment security has occurred. The intended recipient may then make further enquiries as appropriate, before accepting delivery of the goods.

The system may be used by a vehicle having to make deliveries to several different sites, so long as there is a person at each site who is authorized to effect sealing of the compartment and so who has an appropriate key for this purpose. If that key be an electronic key-card, it may be programmed so that it may operate only once, or for a given period of time before it automatically expires. Programming of such a key may be performed only within a secure location, so enhancing security yet further.

The sensing unit 18 may comprise a high security door switch for example mounted within the compartment to prevent inhibition of operation of the switch prior to opening of the door, by which time the unit will have determined unauthorized opening. Other sensing units may equally be employed, to provide the required output to the microprocessor.

Figure 3:
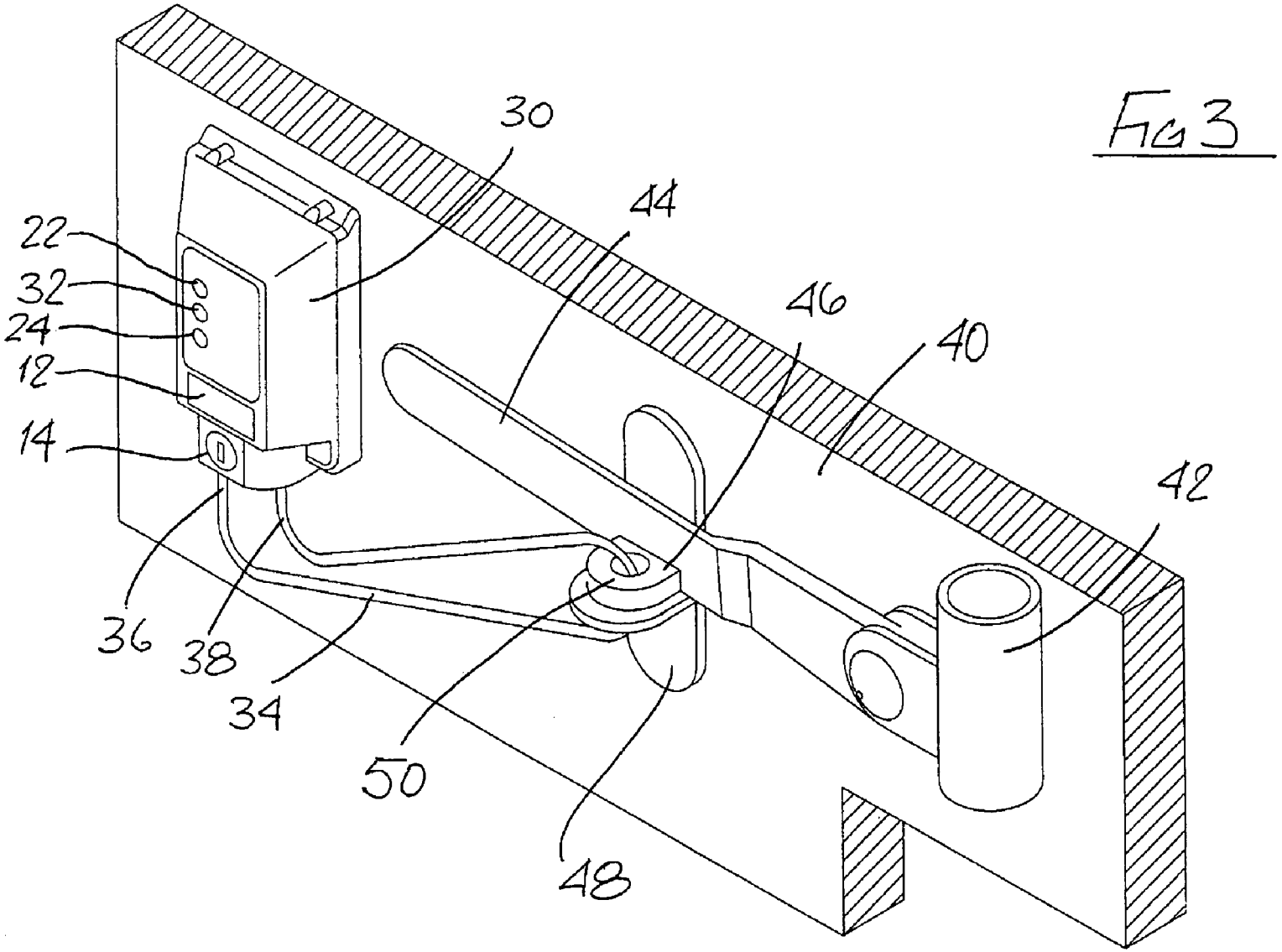
FIG. 3 shows the seal arrangement of FIG. 2 in use on a door or a goods compartment.

Referring now to FIGS. 2 and 3, there is shown a physical embodiment of an enhanced system as described above. Like components with those described above are given like reference characters and will not be described again.

The system of FIGS. 2 and 3 includes a security housing 30 within which is disposed the microprocessor 16, interrogation switch 12 and security switch 14, which in this example comprises a mechanical key switch adapted for use with a suitable coded key (not shown). The interrogation switch 12 comprises a press-panel, to simplify operation and checking of the sealed status. The system includes a third signaling device 32 which may be an amber LED and is disposed between the green signaling device 22 and the red signaling device 24. This third signaling device 32 may be labeled DRIVER SEALED. A flexible security cable 34 has one end 36 held captive within the housing 30 and the other end 38 is releasable from the housing for a limited time period following interrogation of the system, by pressing the interrogation switch 12.

FIG. 2 shows the housing 30 secured to a door 40 of a cargo container or goods compartment of a vehicle. Typically, the housing 30 may be secured in position by screws passing through holes in the door from the inside, and threaded into the housing such that the screws cannot be released from the outside, when the door is closed. The door is provided with a lock mechanism to hold the door in a closed position, that lock mechanism including a tubular operating member 42 mounted for rotation about its axis. A handle 44 is pivoted to the operating member 42 and has a lug 46 secured thereto. A bracket 48 is mounted on the door and has a projecting plate 50, for supporting the handle 44 when the door has been locked closed. Aligned openings 52 are formed in the lug 46 and plate 50.

The door, when locked closed, may be sealed by the security system of this invention by removing the other end 38 of the cable 34 from the housing, passing it through the aligned openings 52 and then re-entering the other end 38 into the housing 30. The other end is held there until the door is to be opened.

The basic operation of the security system of FIGS. 2 and 3 is as described above with reference to FIG. 1. However, the system is enhanced by permitting the indication of a third door sealed status, by the amber LED signaling device 32. The driver or other person associated with the transit of the vehicle may be provided with a special key receivable in the security switch 14, by means of which the driver may re-seal the compartment once opened, following the initial sealing by a fully authorized and responsible person. Should this occur, subsequent operation of the interrogation switch 12 will cause the signaling device 32 to be illuminated, so indicating that the door has been opened but sealed again by the driver, following the initial sealing. This will warn the recipient of the goods that there is a possible breach of security and the recipient may then make appropriate enquiries to determine why this occurred. It could be that the driver was authorized to make a drop of a part-load on route to the destination, or that government authorities (such as Customs authorities) have insisted on checking the contents of the compartment or container.

In both of the above embodiments, the door movements and operations of the switches may be held in a non-volatile memory associated with the microprocessor and could include time and date information. In the case of the use of an electronic key-card, the stored data could also record information from that key-card. The information may be downloaded to a land-based computer system for example at a central control station, either by a wire or a wireless link.

It will be appreciated that though the invention has been particularly described in the foregoing embodiments it is not to be regarded as limited to the details thereof. Variations and modifications thereof are possible within the spirit and scope of the appended claims.

The invention claimed is:

1. A security system for a compartment having a closure member, which security system is arranged to permit sealing of the closure member and to monitor a sealed status thereof, the security system comprising:

a detector for sensing opening and closing movement of the closure member and providing a detector output;

a first input device providing an electrical first device output, the first input device being in the form of a security switch operable solely by means of an authorized user having the appropriate key and independently of a geographical location system, the first input device having a first function for signifying sealing of the compartment;

a second input device providing an electrical second device output, the second input device being operable by any person and having a second function for checking the sealed status of the compartment;

an indicator having at least first and second states indicative of whether or not unauthorized access has been made to the compartment once sealed; and an access verification controller arranged to control the indicator depending upon said outputs received from the detector and the input devices.

2. A security system as claimed in claim 1, wherein the indicator has first and second indicator lights, the first light being associated with the first state of the indicator and the second light with the second state thereof.

3. A security system as claimed in claim 1, wherein the first state of the indicator corresponds to the closure member having been sealed closed by an authorized user arid the compartment has not been opened thereafter.

4. A security system as claimed in claim 1, wherein the second state of the indicator corresponds to the closure member having been opened at least once, following sealing by an authorized user.

5. A security system as claimed in claim 1, wherein the indicator has a third state also indicative of whether access has been made to the compartment, once sealed.

6. A security system as claimed in claim 5, wherein the indicator has first, second and third indicator lights, the first light being associated with the first state of the indicator, the second light with a second state thereof and the third light with a third state thereof.

7. A security system as claimed in claim 6, wherein the first state as indicated by the first light corresponds to the closure member having been sealed closed by an authorized user and the compartment has not been opened thereafter.

8. A security system as claimed in claim 7, wherein the second state as indicated by the second light corresponds to the closure member having been opened only once, following sealing by an authorized user.

9. A security system as claimed in claim 8, wherein the second state corresponds to the closure member having been sealed by an authorized user, following a previous sealing by an authorized user.

10. A security system as claimed in claim 9, wherein the third state as indicated by the third light corresponds to one of the closure member having been opened more than once, following sealing by an authorized user, and the closure member having been opened and closed other than by an authorized user.

11. A security system as claimed in claim 1, wherein the compartment comprises a goods-carrying compartment of a commercial vehicle and the closure member comprises a closable access door to the compartment.

12. A security system as claimed in claim 1, wherein the access verification controller comprises a microprocessor running a control program.

13. A security system as claimed in claim 12, wherein the control program of the microprocessor stores data relating to all openings, closings and authorized sealings of the closure member, for subsequent download.

14. A security system as claimed in claim 13, wherein the control program associates said data with date and time information concerning each event stored.

15. A security system for a compartment having a closure member, which security system is arranged to permit sealing of the closure member and to monitor a sealed status thereof, the security system comprising:

a detector for sensing opening and closing movement of the closure member and providing a detector output;

a first input device providing an electrical first device output, the first input device being in the form of a security switch operable solely by means of an authorized user having the appropriate key and independently of a geographical location system, the first input device having a first function for signifying sealing of the compartment;

a second input device providing an electrical second device output, the second input device being operable by any user and having a second function for checking the sealed status of the compartment;

an indicator having first, second and third states indicative of whether unauthorized or authorized access has been made to the compartment once sealed; and an access verification controller arranged to control the indicator depending upon said outputs received from the detector and the input devices, whereby the first state of the indicator corresponds to the closure member having been sealed closed by an authorized person and the compartment has not been opened thereafter, the second state of the indicator corresponds to the closure member having been opened at least once following sealing by an authorized user and then resealed by an authorized user, and the third state of the indicator corresponds to the closure member having been opened following sealing by an authorized user and then sealed again other than by an authorized user.

16. A security system as claimed in claim 15, wherein the compartment comprises a goods-carrying compartment of a commercial vehicle and the closure member comprises a closable access door to the compartment.

17. A security system as claimed in claim 16, wherein the detector comprises a link adapted for passing through a closure mechanism for the access door of the compartment, which link may be connected only once the door has been closed and which link must be disconnected to permit opening of the door, the detector sensing the connection and disconnection of the link.

18. A security system as claimed in claim 15, wherein the second input device comprises a manually-operable switch.

19. A security system as claimed in claim 15, wherein the access verification controller comprises a microprocessor running a control program.

20. A security system as claimed in claim 19, wherein the control program of the microprocessor stores data relating to all openings, closings and authorized sealings of the closure member, for subsequent download.

* * * * *

UNITED STATES PATENT AND TRADEMARK OFFICE

CERTIFICATE OF CORRECTION

PATENT NO. : 7,068,162 B2
APPLICATION NO. : 10/604049
DATED : June 27, 2006
INVENTOR(S) : Maple et al.

It is certified that error appears in the above-identified patent and that said Letters Patent is hereby corrected as shown below:

Claim 3, Column 7, line 57, reads: "...closed by an authorized user arid the…"

It should read: "...closed by an authorized user and the"

Signed and Sealed this

Twenty-ninth Day of August, 2006

JON W. DUDAS
*Director of the United States Patent and Trademark Office*

UNITED STATES PATENT AND TRADEMARK OFFICE

CERTIFICATE OF CORRECTION

PATENT NO. : 7,068,162 B2
APPLICATION NO. : 10/604049
DATED : June 27, 2006
INVENTOR(S) : Maple et al.

It is certified that error appears in the above-identified patent and that said Letters Patent is hereby corrected as shown below:

Column 1, line 37 reads: "...and sealing the door the container or compartment,"

It should read: --...and sealing the door of the container or compartment,--

Column 1, line 43 reads: "…compared that recorded at the dispatch site."

It should read: --……compared with that recorded at the dispatch site.--

Claim 3, Column 7, line 57, reads: "...closed by an authorized user arid the..."

It should read: --...closed by an authorized user and the--

Signed and Sealed this

Seventeenth Day of October, 2006

JON W. DUDAS
*Director of the United States Patent and Trademark Office*